US006104373A

United States Patent [19]

Klein

[11] Patent Number: 6,104,373

[45] **Date of Patent: *Aug. 15, 2000**

[54] APPARATUS FOR DISPLAYING DATA ON A VIDEO DISPLAY

[75] Inventor: Dean A. Klein, Eagle, Id.

[73] Assignee: Micron Electronics, Inc., Nampa, Id.

[ * ] Notice: This patent issued on a continued prosecution application filed under 37 CFR 1.53(d), and is subject to the twenty year patent term provisions of 35 U.S.C. 154(a)(2).

[21] Appl. No.: 08/918,495

[22] Filed: Aug. 22, 1997

Related U.S. Application Data

[63] Continuation of application No. 08/712,893, Sep. 12, 1996.

[51] Int. Cl.[7] ..... G09G 5/00

[52] U.S. Cl. ..... 345/132; 345/508

[58] Field of Search ..... 345/1, 3, 132, 345/507, 508, 511, 512, 516; 711/100

[56] References Cited

U.S. PATENT DOCUMENTS

| | | | |
|---|---|---|---|
| 4,696,004 | 9/1987 | Nakajima et al. | 714/736 |
| 5,402,148 | 3/1995 | Post et al. | 345/132 |
| 5,488,385 | 1/1996 | Singhal et al. | 345/3 |
| 5,751,259 | 5/1998 | Iwamoto | 345/8 |
| 5,799,202 | 8/1998 | Rongione | 345/516 |

OTHER PUBLICATIONS

Silicon Motion, Inc. Product description for the Lynx SM910, obtained off the Internet—http://www.siliconmotion.com/product.htm; publication date unknown.

*Primary Examiner*—Lun-Yi Lao
*Attorney, Agent, or Firm*—Trop, Pruner & Hu, P.C.

[57] ABSTRACT

In a method and apparatus for displaying data on a video display that is controlled by a video controller, the video controller is coupled to a high-speed memory and a low-speed memory. The memories have separate data paths. A video address corresponding to a location on the video display is received. If a specified address bit is in a first state, then data is displayed from the high-speed memory. If the specified address bit is in a second state, then data is displayed from the low-speed memory. The specified address bit may be a high order address bit that is not utilized by a conventional VGA controller to transmit address information.

17 Claims, 3 Drawing Sheets

APPARATUS FOR DISPLAYING DATA ON A VIDEO DISPLAY

This is a continuation of co-pending application Ser. No. 08/712,893 filed Sep. 12, 1996.

1. BACKGROUND OF THE INVENTION

The invention relates to a method and apparatus for displaying data on a video display. More specifically, the invention relates to a method and apparatus for displaying data on a video display controlled by a video controller subsystem having a high-speed memory and a low speed memory.

Many modem personal computers contain a relatively small number of electronic components. The motherboard components typically include a microprocessor, system memory, video memory, a video controller, and a chipset.

Video memory is a block of RAM in the video subsystem in which displayable data is stored. The video memory typically lies within the address space of the microprocessor. Thus, a program executing within the microprocessor can read from and write to video memory in the same way that is accesses system memory.

The video controller is a device that continually and repeatedly refreshes a video display by generating horizontal and vertical timing signals. The video controller also increments a video memory address counter at a rate that is synchronized with the timing signals. The video controller then reads data from the video memory using the address counter and decodes the data. Next, the video controller sends the decoded color and brightness signals along with the timing signals to the video display. This reading, decoding and sending cycle repeats between 60 and 78 times per second on conventional personal computers.

As a result of the synchronization discussed above, each bit or group of bits in the video memory specifies the color and brightness of a particular pixel on the video display. Thus, a bit can be said to correspond to a particular location on the video display.

As is well known by those skilled in the art, the chipset performs the function of interfacing the microprocessor to system memory and to system busses. In an effort to further reduce the component count and system cost, some modem chipset designs integrate the video controller and the chipset on a single device. This device will be referred to as an integrated chipset. The integrated chipset is made possible by the advancement of packaging technologies such as the high pin-count ball grid array (BGA) packages. The BGA packages allow a single device to incorporate all the required interfaces between the system memory and the microprocessor.

The inclusion of the video controller into the chipset may also eliminate the need for a separate video memory. However, if system memory is used to store video data, a reduction in performance occurs. This reduction in performance is due to the fact that both the video controller and microprocessor must share access to system memory. A personal computer with a state-of-the-art memory bus has a theoretical peak transfer rate of 264 MB/sec (Megabytes/sec). However, a 72 Hz video display system with a resolution of 1280×1024 pixels, each pixel being one of a possible 64 thousand colors, requires a video data bandwidth of approximately 260 MB/sec. Even a more moderate 72 Hz video display system with a resolution of 800×600 pixels, each pixel being one of a possible 64 thousand colors, requires a video data bandwidth of approximately 100 MB/sec. Thus, it is evident that the video data bandwidth is a significant portion of the total system memory bandwidth of a personal computer. As a result, the microprocessor must spend significant portions of its time waiting for access to system memory.

In addition, to the high pin-count packages, recent advances in semiconductor processing have reduced semiconductor geometries. Thus, space exists on the integrated chipset die for additional functionality.

2. SUMMARY OF THE INVENTION

The invention relates to a method and apparatus for displaying data on a video display that is controlled by a video controller. The video controller is coupled to a high-speed memory and a low-speed memory. The memories have separate data paths. The method consists of first receiving a video address corresponding to a location on the video display. Next, if a specified address bit is in a first state, then data is displayed from the high-speed memory. If the specified address bit is in a second state, then data is displayed from the low-speed memory. The specified address bit may be a high order address bit that is not utilized by a conventional VGA controller to transmit address information.

3. BRIEF DESCRIPTION OF THE DRAWINGS

4. DESCRIPTION OF ILLUSTRATIVE EMBODIMENTS

In the following detailed description numerous specific details are set forth in order to provide a thorough understanding of the present invention. However, it will be understood by those skilled in the art that the present invention may be practiced without these specific details. In other instances, well known methods, procedures, components, and circuits have not been described in detail so as not to obscure the present invention.

Some portions of the detailed descriptions which follow are presented in terms of algorithms and symbolic representations of operations on data bits within a computer memory. These algorithmic descriptions and representations are the means used by those skilled in the art to most effectively convey the substance of their work to others skilled in the art. An algorithm is here, and generally, conceived to be a self-consistent sequence of steps leading to a desired result. The steps are those requiring physical manipulations of physical quantities. Usually, though not necessarily, these quantities take the form of electrical or magnetic signals capable of being stored, transferred, combined, compared, or otherwise manipulated. It has proven convenient at times, principally for reasons of common usage, to refer to these signals as bits, values, elements, symbols, characters, terms, numbers, or the like. It should be born in mind, however, that all of these and similar terms are to be associated with the appropriate physical quantities and are merely convenient labels applied to these quantities. Unless specifically stated otherwise as apparent from the following discussions, it is appreciated that terms such as "processing," "computing," "calculating," "determining" or the like, refer to the action and processes of a computer system or similar electronic computing device, that manipulates and transforms data represented as physical (electronic) quantities within the computer system's registers and/or memories into other data similarly represented as physical quantities within the computer system memories, registers and/or other such information storage, transmission, or display devices.

4.1 Video Controller Subsystem

Figure 1:
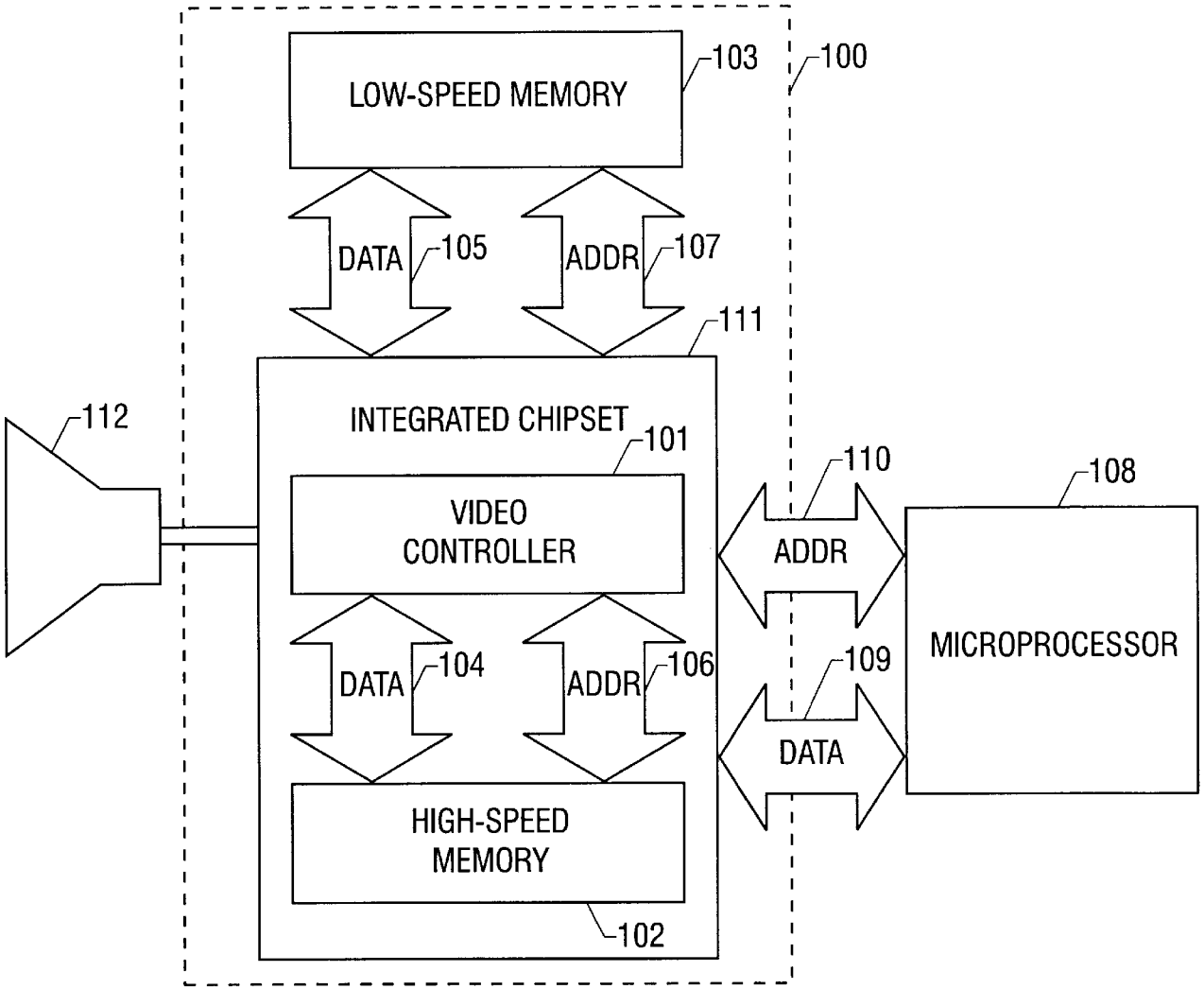
FIG. 1 is a simplified view of an embodiment of the present invention.

As shown in FIG. 1, the video controller subsystem 100 of the present invention consists of a video controller 101, and two memories 102 and 103. The first memory, referred to as high-speed memory 102, is capable of operating at a higher speed than the second memory. The second memory will be referred to as low-speed memory 103. The video controller subsystem 100 is connected to a microprocessor 108 by a datapath 109 and an address bus 110. In addition, the video controller subsystem 100 is conventionally connected to a video display 112. The video display 112 can be any conventional video display such as a cathode ray tube or a flat panel display.

The video controller 101 of the video controller subsystem 100 is connected to the memories 102 and 103 by two different datapaths 104 and 105. In addition, the video controller may be connected to the memories by two different address busses 106 and 107.

Figure 2:
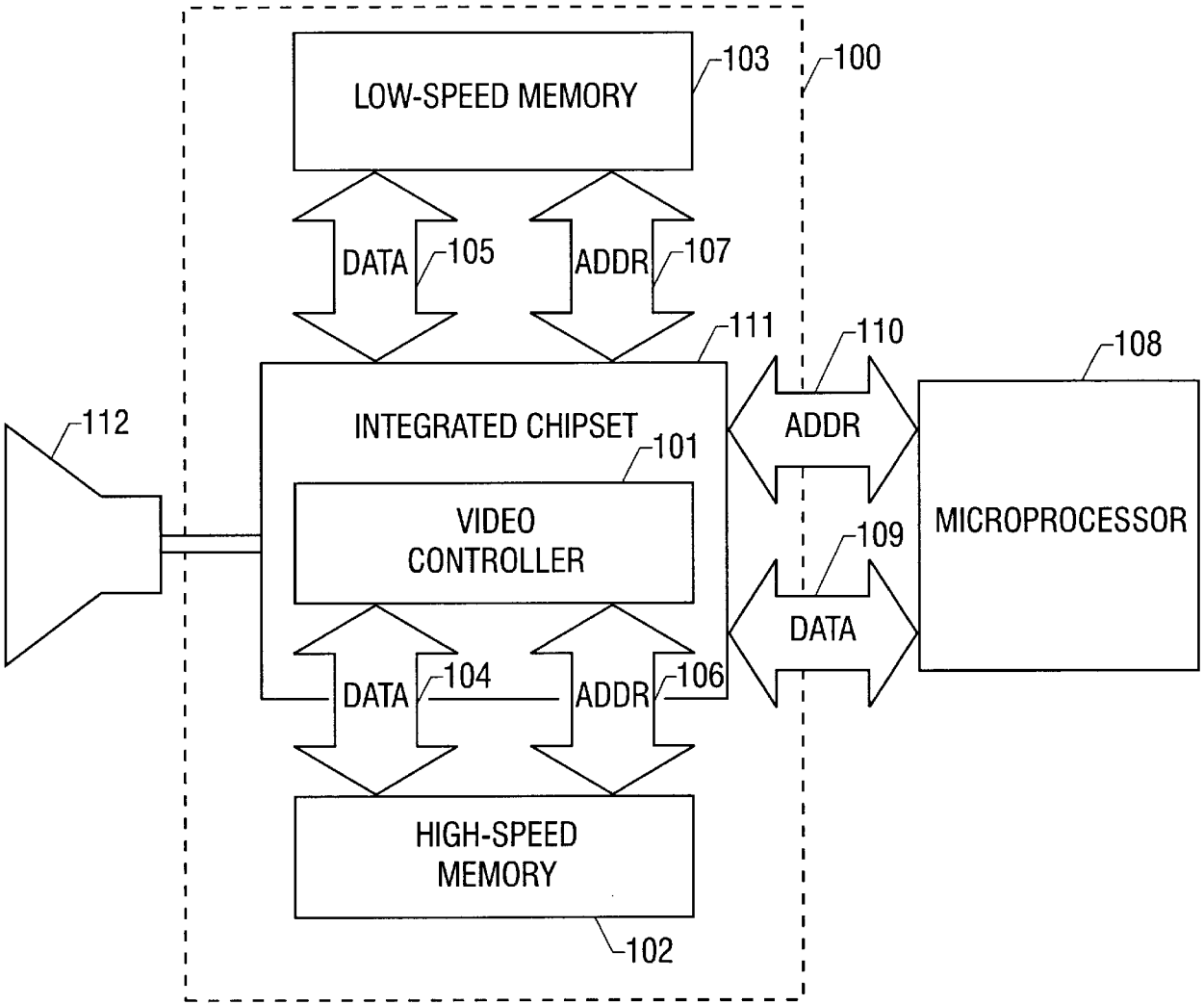
FIG. 2 is a simplified view of an alternative embodiment of the present invention.

As shown in FIG. 1, the high-speed memory 102 may be included on the die of the integrated chipset 111 while the low-speed memory 103 may be conventional system memory. Alternatively, as shown in FIG. 2, the high-speed memory 102 may be distinct from the integrated chipset 111.

4.2 Method of Operation

Figure 3:
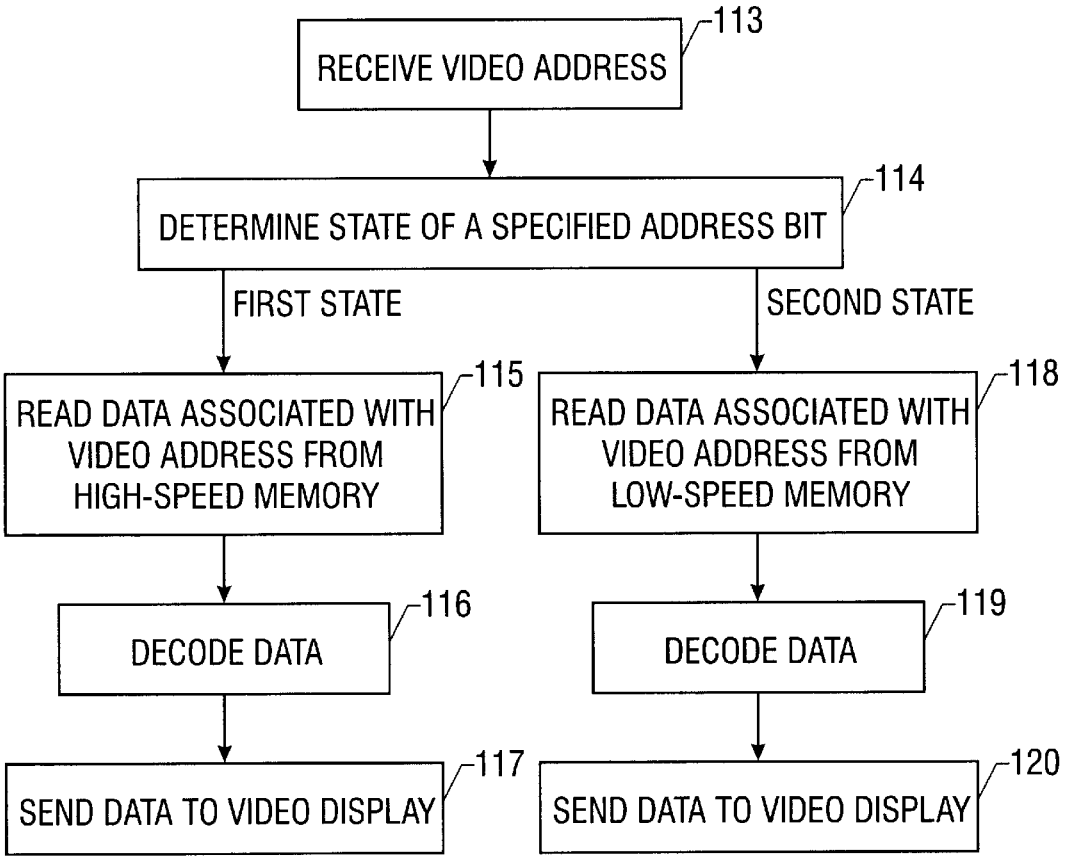
FIG. 3 is a flow-chart overview of a method usable with the apparatus of FIG. 1 and/or FIG. 2.

As shown in block 113 of FIG. 3, the integrated chipset 111 first receives a video address from the microprocessor 108. This video address corresponds to a particular location on the video display at which data is to be displayed. This video address is communicated from the microprocessor 108 to the integrated chipset 111 by address bus 110.

Address bus 110 contains a plurality of conventional address lines. These address lines communicate address bits to the video controller 101. These address bits can be subdivided into high order address bits and low order address bits. A low order address bit is an address bit that is utilized to communicate address information in a conventional Video Graphics Array (VGA) video controller. As is known in the art, the VGA video controller has become the de facto video controller standard in part because it was included in the original IBM PS/2 Models 50, 60, and 80. A high-order address bit is an address bit that is not a low-order address bit.

Next, as shown in block 114 of FIG. 3, circuitry in the integrated chipset 111 determines the state of a specified address bit in address bus 110. As shown in blocks 115–117 of FIG. 3, if the state of the specified address bit is in a first state, then data stored within the high-speed memory 102 is repeatedly read, decoded, and sent to the video display 112. Thus, if the state of the specified address bit is in a first state, then data is displayed from the high-speed memory 102 on the video display 112. Similarly, as shown in blocks 118–120 of FIG. 3, if the state of the specified address bit is in a second state, then data stored within the low-speed memory 103 is repeatedly read, decoded, and sent to the video display 112.

The specified address bit can be selected so that, in higher resolution modes, the high-speed memory can store data for a portion of the display area. For example, the data corresponding to an upper portion of a video display 112 may be stored in the high-speed memory 102 while the data corresponding to a lower portion of a video display 112 may be stored in the low-speed memory 103. Alternatively, the high-speed memory 102 may store the data corresponding to every Nth line on the video display 112 where N is any positive integer. In another embodiment, where high resolution text is being displayed, the low-speed memory may store ASCII character codes, while the high-speed memory stores one or more fonts.

4.3 Remarks

Use of the invention permits an economical video subsystem that contains high-speed VGA compatible video memory. Thus, VGA compatible software can be efficiently executed. Because the high-speed VGA compatible memory data bus is distinct from the system memory data bus, no reduction in system performance occurs when executing VGA compatible software. For economical reasons and/or because the available die space is limited only a limited amount, such as 256K, of high-speed memory may be included on the integrated chipset.

Even though the amount of high-speed memory is limited, the invention supports high resolution video modes that require large amounts of memory. When high resolution video modes are utilized, the video subsystem can utilize low-speed system memory to satisfy the additional storage requirements. Because only a portion of the display is stored in system memory, the system performance reduction is reduced.

4.4 Program Storage Device

Any of the foregoing variations may be implemented by programming a suitable video controller having appropriate hardware. The programming may be accomplished through the use of a program storage device readable by the video controller and encoding a program of instructions executable by the computer for performing the operations described above. The program storage device may take the form of, e.g. one or more floppy disks, a hard disk, a CD ROM or other optical, magnetic or combination optical/magnetic disk, a magnetic tape, a read-only memory chip (ROM), and other forms of the kind well-known in the art or subsequently developed. The program of instructions may be "object code," i.e., in binary form that is executable more or less directly by the video controller, in "source code" that requires compilation or interpretation before execution, or in some intermediate form such as partially compiled code. The precise forms of the program storage device and of the encoding of instructions are immaterial here except as may be noted otherwise above.

It will be appreciated by those of ordinary skill having the benefit of this disclosure sure that the illustrative embodiments described above are capable of numerous variations without departing from the scope and spirit of the invention. Accordingly, the exclusive rights sought to be patented are as described in the claims below.

What is claimed is:

1. A video controller subsystem for controlling display of video data on a video display, comprising:

(a) a video controller;

(b) a high-speed memory accessible by the video controller and storing a first portion of the video data;

(c) a low-speed memory accessible by the video controller and storing a second, different portion of the video data, the video controller alternately accessing the first and second video data portions for display on the video display to reduce bandwidth requirement for video data in the low-speed memory;

(d) a first datapath coupling the high-speed memory to the video controller; and (e) a second datapath coupling the low-speed memory to the video controller.

2. The video controller subsystem of claim 1, wherein the low-speed memory comprises system memory of a computer system.

3. The video controller subsystem of claim 1, wherein the video controller is an integrated video controller.

4. The video controller subsystem of claim 3, wherein the low-speed memory comprises system memory of a computer system.

5. The video controller subsystem of claimcv 1, wherein the high-speed memory is embedded in the video controller.

6. The video controller subsystem of claim 5, wherein the low-speed memory is external to the video controller.

7. The video controller subsystem of claim 1, wherein the video controller is adapted to access video data stored in the high-speed memory over the first datapath and access video data stored in the low-speed memory over the second datapath.

8. The video controller subsystem of claim 7, wherein the video controller is adapted to provide the first video data portion for display on a first portion of the video display and to provide the second video data portion for display on a second portion of the video display.

9. The video controller subsystem of claim 8, wherein the high-speed memory stores video data corresponding to every Nth line on the video display.

10. An article including one or more machine-readable storage media containing instructions executable in a system having a video controller coupled to a high-speed memory and a low-speed memory over separate datapaths, the instructions when executed causing the system to:

receive a video address corresponding to a location on a video display;

in response to a specified video address bit being at a first state, read video data at a first rate over a first datapath from the high-speed memory and display the read video data on one part of the video display; and in response to the specified video address bit being at a second state, read video data at a second rate different from the first rate over a second datapath from the low-speed memory and display the video data accessed from the low-speed memory on an other part of the video display.

11. The article of claim 10, wherein the specified bit is a high order video address bit for a VGA video mode.

12. The article of claim 10, wherein the high-speed memory has a capacity less than the total amount of data to be displayed on the video display.

13. A system including a video controller, a high-speed memory, a low-speed memory, a first datapath coupling the high-speed memory to the video controller, a second datapath coupling the low-speed memory to the video controller, a video display, and a program that when executed causes the system to:

store a first portion of video data for display on the video display in the high-speed memory;

store a second portion of video data for display on the video display in the low-speed memory; and alternately access the first and second video data portions in response to received video addresses to retrieve video data for display on to reduce bandwidth requirement for the video data in low-speed memory.

14. The system of claim 13, wherein the video addresses include a specified bit that is a high order video address bit for a VGA video mode.

15. The system of claim 13, wherein the video display is a cathode ray tube.

16. The system of claim 13, wherein the video display is a flat panel display.

17. The system of claim 13, wherein the high-speed memory has a capacity less than the total amount of data to be displayed on the video display.

* * * * *

UNITED STATES PATENT AND TRADEMARK OFFICE

CERTIFICATE OF CORRECTION

PATENT NO. : 6,104,373

DATED : August 15, 2000

INVENTOR(S) : Dean A. Klein

It is certified that error appears in the above-identified patent and that said Letters Patent are hereby corrected as shown below:

In col. 5, line 11, replace "claimcv" with -- claim --.
In col. 6, line 25, after "for display on" insert -- the video display --.
In col. 6, line 26, after "video data in" insert --the--.

Signed and Sealed this

First Day of May, 2001

*Attest:*

Nicholas P. Godici

NICHOLAS P. GODICI

*Attesting Officer*

*Acting Director of the United States Patent and Trademark Office*